US007730574B1

(12) United States Patent
Cox, Sr.

(10) Patent No.: US 7,730,574 B1
(45) Date of Patent: Jun. 8, 2010

(54) CLEANING APPARATUS THAT IS WORN OVER A HAND

(76) Inventor: Eric Anthony Cox, Sr., 1160 Cunningham St., Vallejo, CA (US) 94590

( * ) Notice: Subject to any disclaimer, the term of this patent is extended or adjusted under 35 U.S.C. 154(b) by 1144 days.

(21) Appl. No.: 11/334,110

(22) Filed: Jan. 17, 2006

(51) Int. Cl.
*A47L 13/18* (2006.01)
*A41D 19/00* (2006.01)

(52) U.S. Cl. ..... 15/227

(58) Field of Classification Search ..... 15/227
See application file for complete search history.

(56) References Cited

U.S. PATENT DOCUMENTS 580,752 A * 4/1897 Bailey ..... 30/123.5
1,633,300 A * 6/1927 Wetzstein ..... 2/158
1,713,065 A * 5/1929 Williams ..... 401/201
1,979,130 A * 10/1934 Wiley ..... 2/168
2,049,323 A * 7/1936 Schmidt ..... 15/227
2,530,746 A * 11/1950 Wetherby ..... 15/104.94
2,651,071 A * 9/1953 Dyer et al. ..... 15/227
2,821,731 A * 2/1958 May ..... 15/227
3,982,298 A * 9/1976 Ota ..... 15/106
4,051,572 A * 10/1977 Greenwood ..... 15/227
D268,968 S * 5/1983 Sami ..... D29/117.1
4,788,733 A * 12/1988 Lerner ..... 15/104.94
4,902,283 A * 2/1990 Rojko et al. ..... 604/290
6,016,571 A * 1/2000 Guzman et al. ..... 2/167
6,532,597 B2 * 3/2003 Bignon et al. ..... 2/161.6
6,604,244 B1 * 8/2003 Leach ..... 2/161.6

* cited by examiner

*Primary Examiner*—Randall Chin
(74) *Attorney, Agent, or Firm*—Risto A. Rinne, Jr.

(57) ABSTRACT

An apparatus for the cleaning and washing of objects includes a flexible inner lining that extends over a hand and wrist or arm of a user so as to provide a gap intermediate the exterior of at least a portion of the hand and the interior of the inner lining. A preferred material for the inner lining is fabricated neoprene, rubber, or latex. An outer lining extends over at least a portion of the inner lining and is adapted for a cleaning, polishing, or dusting operation. A preferred material for the outer lining includes cotton fibers. The apparatus is available in either a "gloved" version with fingers or in a "mitt" version that accommodates a plurality of fingers. Both versions, preferably, include a thumb area as well. A first seal surrounds the apparatus around the wrist or arm of the user and is tightened to restrict the inflow of a fluid into the apparatus. A second seal is parallel to the first seal and further restricts the inflow of the fluid and prevents entry of a substantial quantity of the fluid into the gap.

19 Claims, 2 Drawing Sheets

CLEANING APPARATUS THAT IS WORN OVER A HAND

RELATED APPLICATION

This application is related to prior application Ser. No. 09/550,691 filed on Apr. 17, 2000, now abandoned.

BACKGROUND OF THE INVENTION

1. Field of the Invention

The present invention, in general relates to mops and rags and the like that are used for dusting, washing, cleaning, and polishing and, more particularly, to mittens and gloves that are adapted to assist with these and other cleaning tasks and purposes.

Devices that are worn over the hand, like a mitten with a cotton surface are known types of devices that are used to wash, apply wax, remove wax, dust, and the like.

Business establishments that wash automobiles are familiar with such types of devices and often use them. These types of businesses are commonly referred to as "car washes".

At car washes, personnel will often wear a cotton type of a mitt (or mitten) and wash automobiles or portions of automobiles as they pass by.

A problem occurs in that when cold water is used, such as at car washes, and such a type of a mitt is used, the hand of the person becomes very cold. A knuckle joint (or joints) in particular, may start to ache.

Sustained exposure to cold water is, itself, painful and may have long term negative consequences. The linkage between frequent and protracted exposure to cold water and the effect on joints is not known. Can this lead to arthritis or to other maladies? If so, is there a potential liability to car washes? These types of questions remain unanswered and may require legal action to resolve them.

Clearly, this potential looms ominously to any car wash owner. Regardless of any liability considerations, the fact that any type of an exposure to cold water makes the job of washing cars more difficult is, itself, a certainty. This can result in job dissatisfaction and in the quick turn over of personnel, which is another consequence that often affects and adds expense to the car wash owner.

While the focus in the preceding discussion has been car washes, it is to be understood that this problem is not limited only to car washes. Window washers as well as general cleaning personnel, including "maid" services and other specialized types of commercial, industrial, or residential cleaning services may experience nearly identical or similar or related types of problems from an exposure to cold water or to some other type of a cold fluid that is used as a cleaning solution.

Excessively hot water or fluids can have a similar negative effect. Exposure to fluids that are too hot is also painful and potentially damaging.

Accordingly there exists today a need for a cleaning apparatus that is worn over a hand which aids in cleaning, dusting, and polishing tasks and helps to insulate the hand of the user.

Clearly, such an apparatus would be a useful and desirable device.

2. Description of Prior Art

Dust mitts are, in general, known. For example, a product that is called "WASH MITT" is commercially available. This product is for washing and dusting purposes and it is formed from 100% cotton denille.

While the structural arrangements of the above described device and other similar types of devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a cleaning apparatus that is worn over a hand that insulates the hand of a user.

It is also an important object of the invention to provide a cleaning apparatus that is worn over a hand that includes an inner lining.

Another object of the invention is to provide a cleaning apparatus that is worn over a hand that includes an inner lining that provides thermal insulation to a user.

Still yet another object of the invention is to provide a cleaning apparatus that is worn over a hand that includes a glove.

Yet another important object of the invention is to provide a cleaning apparatus that is worn over a hand that includes a mitten.

Still yet another important object of the invention is to provide a cleaning apparatus that is worn over a hand that includes an inner lining and a material adapted for a cleaning task, the material being disposed over at least a portion of the inner lining.

One further object of the invention is to provide a cleaning apparatus that provides an increase in the time a hand of a user may be exposed to a cold fluid.

One still further object of the invention is to provide a cleaning apparatus that provides an increase in the time a hand of a user may be exposed to a hot fluid.

A first continuing object of the invention is to provide a cleaning apparatus that prevents contact of a fluid with the hand.

A second continuing object of the invention is to provide a cleaning apparatus that is worn over a hand and which provides a seal proximate a wrist of a wearer that prevents fluid from contacting the hand.

A third continuing object of the invention is to provide a cleaning apparatus that is worn over a hand and which provides an adjustable seal proximate a wrist of a wearer that prevents fluid from contacting the hand.

A fourth continuing object of the invention is to provide a cleaning apparatus that is worn over a hand and which provides a pair of seals proximate a wrist of a wearer that prevents fluid from contacting the hand.

Briefly, a cleaning apparatus that is worn over a hand that is constructed in accordance with the principles of the present invention has an inner lining that is flexible and is adapted to receive at least a portion of a hand therein. The inner lining may include a mitt portion only, or it may include a mitt portion and a thumb portion, or it may include individual finger portions, either with or without a thumb portion. A layer of material, such as cotton fibers, are attached over the exterior of at least a portion of the inner lining. In use, a fluid, typically water or a water-based cleaning solution, is used and an adjustable seal proximate a wrist of the user provides a seal that prevents fluid from contacting the hand of the user. Accordingly, the hand remains comfortable for long periods of time even when it is immersed in cold or hot fluids. The seal includes, preferably, a first and a second seal, which together provide an especially effective barrier to prevent the fluid from contacting the hand of the user.

DETAILED DESCRIPTION OF THE INVENTION

Figure 1:
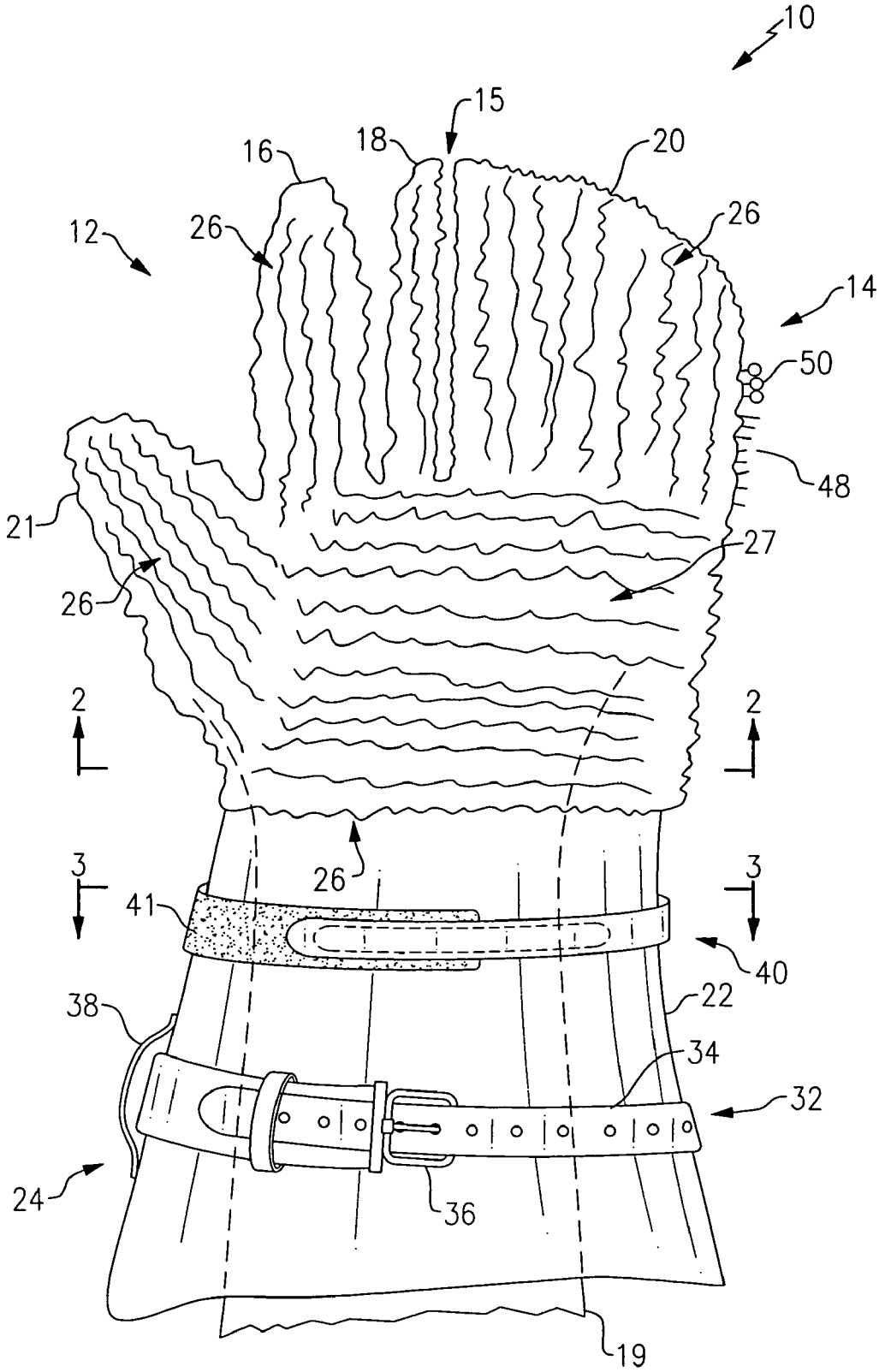
FIG. 1 is a cleaning apparatus that is worn over a hand of a user.
Figure 2:
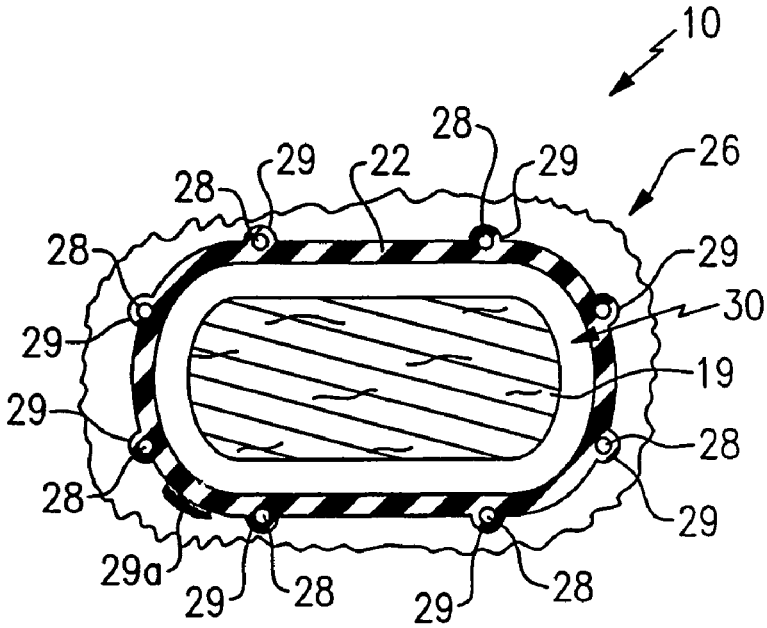
FIG. 2 is a cross sectional view taken on the line 2-2 in FIG. 1 of the cleaning apparatus that is worn over a hand.
Figure 3:
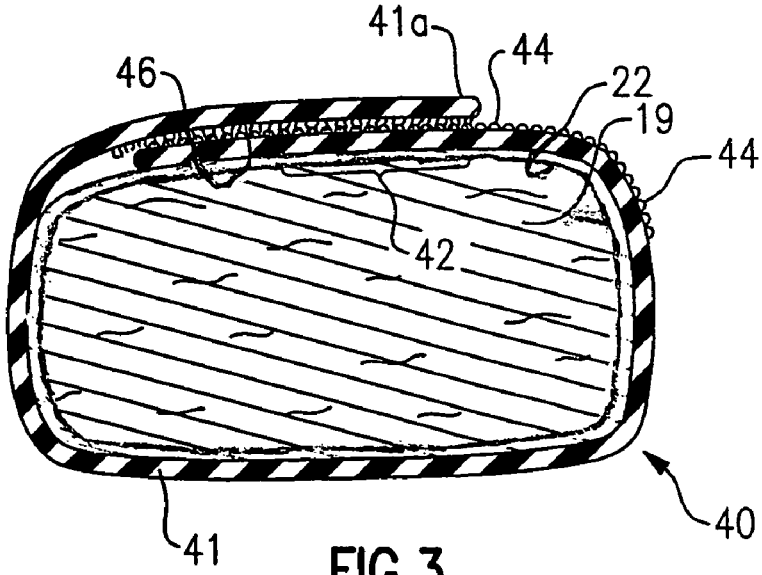
FIG. 3 is a cross sectional view taken on the line 3-3 in FIG. 1 of the cleaning apparatus that is worn over a hand but with a first and a second seal tightened more than in FIG. 1.

Referring to FIG. 1, FIG. 2 and on occasion to FIG. 3 is shown, a cleaning apparatus that is worn over a hand, identified in general by the reference numeral 10. The term "apparatus" and "device" are used interchangeably hereinafter.

The apparatus 10 is divided into a left most portion, identified in general by the reference numeral 12 and a right most portion, identified in general by the reference numeral 14. A split, identified in general by the reference numeral 15 is not normally present but is included only to differentiate between the left most portion 12 and the right most portion 14.

The left most portion 12 is similar to a type of a garment normally referred to as a "glove". The right most portion 14 is similar to a type of a garment normally referred to as a "mitt" or a "mitten".

The terms "mitt" and "mitten" are often used interchangeably and are done so herein as well. Sometimes, the term "mitt" refers to a garment (i.e., an article of clothing) that does not include a separate provision for a thumb, whereas the term "mitten" will include a separate provision to accept a thumb.

The apparatus 10, in any of its many possible embodiments, may be adapted to include such a separate provision to accept a thumb or is may be omitted according to the preferences of the application at hand.

The left most portion 12 includes finger areas 16, 18. Each of the finger areas 16, 18 is adapted to receive one of four fingers (not shown) of an arm and hand of a user 19. Only the two finger areas 16, 18 are shown. The other two that would normally be included (i.e., with the glove) are not shown to provide an opportunity to show construction of an alternative embodiment (i.e., the mitten).

The user 19, as shown, reveals but a portion of his arm as it extends both from and enters into the apparatus 10.

The right most portion 14 includes a one piece area 20 that is adapted to receive a plurality of the fingers of the user.

In actual use the apparatus 10 would be constructed so as to entirely be either as shown in the left most portion 12 or as shown in the right most portion 14.

The glove style (i.e., the left most portion 12) and the mitten style (i.e., the right most portion 14) as shown each include a thumb area 21. The thumb area 21 may be omitted if desired, as mentioned hereinbefore. The thumb area 21 is adapted to receive a thumb (not shown) of the user 19.

The apparatus 10 includes a inner lining 22 that includes a cuff area, identified in general by the reference numeral 24. The inner lining 22 extends to form the thumb area 21 and each of the finger areas 16, 18 or, alternately, the one piece area 20 of the apparatus 10 depending upon whether the glove or the mitten form is desired.

It is important to note that the inner lining 22 is entirely waterproof. It is formed from a waterproof, flexible material such as rubber, latex, neoprene, etc. The inner lining 22 may be of any color, such as blue, black, or otherwise, as desired.

An outer lining 26 is provided over at least a portion of the inner lining 22. The outer lining 26 is disposed so as to cover the inner lining 22 where desired. Normally, the outer lining 26 would cover at least the finger areas 16, 18, the thumb area 21, the one piece area 20, over a palm area identified in general by the reference numeral 27, and over a back of the hand area (not shown) that is generally disposed on an opposite side of the apparatus 10 with respect to the palm area 27. The task for which the apparatus 10 is to be used determines the amount and location (i.e., the placement) of the outer lining 26 and which portions of the inner lining 22 it is to cover.

The outer lining 26 is formed of any material that is effective for the intended cleaning task. A preferred type of a material includes cotton fibers because they are highly absorbent and soft enough so as not to scratch or mar most surfaces. Other, more abrasive, materials may be used to form the outer lining 26 some of which are discussed in greater detail hereinafter.

The outer lining 26 is attached to the inner lining 22 by the use of a plurality of stitches 28 (FIG. 2) that are placed where desired and in a quantity that is sufficient to adhere the outer lining 26 to the inner lining 22. The stitches 28 penetrate the inner lining 22 which then forms a watertight seal around each of the stitches 28 sufficient to prevent the entry of fluid. If preferred, each of the stitches 28 is treated with a waterproof sealant 29, such as a type of silicone sealant, to ensure that water cannot penetrate through the stitches 28.

The stitches 28 are used when it is desirable to attach the outer lining 26 to the inner lining 22 by a sewing operation. If preferred an adhesive **29*a* is used to attach the outer lining 26 to the inner lining 22**.

In normal use a gap, identified in general by the reference numeral 30 is provided intermediate the hand of the user 19 and an interior of the inner lining 22. There are, of course, contact areas that occur between the user 19 and the lining 22 but in general it is important to note that the gap 30 is substantially free of fluids. The reason this occurs is discussed in greater detail hereinafter.

The gap 30 keeps the hand of the user 19 dry and allows for prolonged use of the cleaning apparatus 10 and for its prolonged immersion in either hot or cold fluids without adversely affecting the comfort of the user 19.

Referring now, also to FIG. 3, is shown in cross section a portion of the cleaning apparatus that includes the inner lining 22 but which does not generally include the outer lining 26.

A first seal, identified in general by the reference numeral 32 is disposed closest to a shoulder portion (not shown) of the user 19.

The first seal 32 includes a belt 34 with holes and a buckle 36, similar to a conventional belt used to support a pair of pants (not shown). At least one loop 38 is attached to the inner lining 22 and is used to retain the belt 34 to the cleaning apparatus 10.

Similar to the way in which the belt on a pair of pants is tightened, the first seal 32 is similarly tightened as much as is comfortable. This causes the inner lining 22 to make contact with the wrist or lower arm portion of the user 19 all around the arm. This provides an effective seal that prevents most of the fluid from passing under the first seal 32 and contacting any of the hand portion of the user.

However, it does not provide a nearly 100% watertight seal as is desired because there are areas of the inner lining 22 that tend to fold in a generally S-shape (in cross-section) pattern as the inner lining 22 is compressed to fit around the wrist or lower arm portion of the user 19.

If the cleaning device 10 is then lowered deep into a container of fluid (i.e., a cleaning solution of some sort, presumably including soapy water) the pressure that is experienced is apt to urge some of the fluid to pass into the cleaning device 10 beyond the first seal 32, especially if the device 10 is held below water level for an extended period of time.

It is desirable that none of the fluid (or very little at most) should enter into the gap 30 during use to ensure maximum comfort for the user 19 and to permit extended use of the cleaning apparatus 10.

Accordingly, a second seal identified in general by the reference numeral 40, is provided intermediate the first seal 32 and a portion of the cleaning device 10 that includes the outer lining 26.

The second seal 40 includes a strap 41. The strap 41 includes an adhesive portion 42 at a first end thereof where it is adhered to an outer surface of the inner lining 22. A side of the strap 41 disposed at the first end and on an opposite side where the adhesive portion 42 is disposed includes a first half 44 of a hook and loop type of fastener, the first half 44 being either the hook or the loop portion. The first half 44 is disposed along a longitudinal length of the strap 41 and it extends for a distance that is generally greater than that of the adhesive portion 42.

A distal end 41*a* of the strap 41 includes a second half 46 of a hook and loop fastener (again, either the hook or the loop portion, but whatever is opposite to that as is used for the first half 44) along a longitudinal length thereof and which is disposed on an inner surface of the strap 41, facing generally toward the inner lining 22.

In use, the distal end 41*a* is grasped and pulled tightly around the inner lining 22. The degree of tightness is the maximum that is comfortable for the user 19. The distal end 41*a* is then placed in contact with the first half 44 so the second half 46 and first half 44 are in contact with each other.

The second seal 40 provides a watertight seal that, in cooperation with the first seal 32, effectively prevents water (fluid) from entering into the gap 30.

An unexpected benefit is provided by the instant invention as described. If only the outer seal 32 or if only the inner seal 40 were used, to prevent the fluid from entering into the gap 30 either seal 32, 40 would have to be tightened to such an extreme extent as to be either uncomfortable or dangerous for the user 19.

At best, either seal 32, 40 would be so uncomfortable as to be wearable for only a short period of time. At worst, either seal 32, 40 would be so tight as to constrict and therefore restrict blood flow to and from the hand. This is potentially dangerous to the user 19. A restricted amount of blood flow would also tend to cool the hand and possibly even make it numb. Either of these conditions would shorten the time that the cleaning device 10 could be used.

However, use of the first seal 32 permits its tightening at a lower tension that is not uncomfortable and which does not restrict blood flow to and from the hand. However, if some fluid does pass into the area between the first seal 32 and the second seal, it is at a greatly reduced pressure and it will not pass beyond the restriction provided by the second seal 40.

Also, if a small quantity of the fluid becomes trapped between the first seal 32 and the second seal 40 that quantity of fluid is heated by the hand and is warmed. That small quantity of fluid that is trapped between the seals 32, 40 allows this portion of the cleaning device 10 to function as a wet suit.

The benefit provided by the two seals 32, 40 is that the hand remains dry during use and this is accomplished without excessive pressure or restriction.

Also, another benefit provided by the first seal 32 and the second seal 40 is that when they are both loosened, they provide virtually no resistance to any placing of the hand of the user 19 into the device 10, as shown in FIG. 1 or withdrawal therefrom.

It is possible to modify the type of seal mechanism for either the first seal 32 or the second seal 40 or both, if desired. However, it is preferred to use the belt for the first seal 32 to provide a durable and wide seal for the first seal 32 and also for the other reasons as mentioned herein. It is desirable to use the hook and loop arrangement for the second seal 40 to provide an especially quick sealing and quick release type of mechanism, as is possible with hook and loop types of fasteners.

If desired, either the first and second seal 32, could include any combination of mechanisms sufficient to provide the desired watertight sealing capability. For example, an elastomeric strap (not shown) could be used for either or both the first seal 32 and/or the second seal 40.

While it is possible to eliminate either the first seal 32 or the second seal 40 but not both, the ability to prevent infiltration of the fluid into the gap 30 is greatly diminished when only one seal (either 32 or 40) is used.

The inner lining 22 provides thermal insulation properties as well. This benefit is also important.

The apparatus 10 is provided in both right (not shown) and left hand versions and in different sizes, as preferred. For certain tasks, only one apparatus 10 will be used at a time. For other tasks, both the right and left hand versions of the apparatus 10 will be used simultaneously.

If preferred, the cuff area 24 can be extended to pass as far as desired up the arm of the user 19. Similarly, the outer lining 26 may cover as much or as little of the cuff area 24 as desired. Additional seals (not shown) may be included with extended cuff 24 versions of the device 10.

If the cleaning task at hand so requires it, the outer lining 26 may include bristles 48 where desired to aid in cleaning. The bristles 48 may be of a soft or stiff material and they may, if desired, include abrasive particles 50.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A cleaning apparatus that is worn over a hand, comprising:

(a) an inner lining, said inner lining formed of a flexible and water resistant material and which is disposed over and fully encircles all of said hand and including a cuff area that, when the cleaning apparatus is worn, extends over a portion of either a wrist or an arm of a user;

(b) an outer lining that is adapted for performing a cleaning task, said outer lining disposed over of said inner lining that is adapted to encircle any portion of said hand;

(c) means for attaching said outer lining to said inner lining; and (d) means for sealing said inner lining adjacent to said wrist or arm sufficient to prevent entry of a substantial quantity of fluid into a gap that is disposed around said wrist or arm;

and wherein said means for sealing said inner lining includes first seal means that is disposed around said cuff area and wherein said first seal means includes a belt having a plurality of holes therein and a buckle, and including second seal means disposed around said cuff area a predetermined distance away from and parallel to said first seal means, and wherein said second seal means includes a strap that is attached to said inner lining at a first end thereof and including a first half of a hook and loop fastener that is attached to said strap proximate said first end, and wherein said strap includes a second end that is disposed at an opposite end of said strap with respect to said first end, and wherein said second end includes a second half of a hook and loop fastener attached thereto that is able to cooperate with and adhere to said first half of said hook and loop fastener when said second half of said hook and loop fastener is urged into contact with said first half of said hook and loop fastener.

2. The cleaning apparatus of claim 1 wherein said inner lining includes neoprene.

3. The cleaning apparatus of claim 1 wherein said inner lining includes fabricated neoprene.

4. The cleaning apparatus of claim 1 wherein said outer lining includes cotton.

5. The cleaning apparatus of claim 1 wherein said outer lining includes cotton fibers.

6. The cleaning apparatus of claim 1 including a plurality of finger areas, each of said finger areas is adapted to receive a finger therein.

7. The cleaning apparatus of claim 1 including a one-piece area that is adapted to receive a plurality of fingers therein.

8. The cleaning apparatus of claim 1 including a thumb area that is adapted to receive a thumb therein.

9. The cleaning apparatus of claim 1 wherein said means for sealing said inner lining includes a first seal means disposed around said cuff area.

10. The cleaning apparatus of claim 9 wherein said means for sealing said inner lining includes a second seal means disposed around said cuff area.

11. The cleaning apparatus of claim 10 wherein said second seal means includes a strap and a first half of a hook and loop fastener and a second half of a hook and loop fastener.

12. The cleaning apparatus of claim 9 wherein said first seal means includes a belt and buckle.

13. The cleaning apparatus of claim 1 wherein said means for attaching includes sewing said outer lining to said inner lining.

14. The cleaning apparatus of claim 1 wherein said means for attaching includes a plurality of stitches to retain said outer lining to said inner lining.

15. The cleaning apparatus of claim 14 including a sealant that is applied over said plurality of stitches.

16. The cleaning apparatus of claim 1 wherein said means for attaching said outer lining to said inner lining includes adhering said outer lining to said inner lining.

17. The cleaning apparatus of claim 1 wherein said outer lining includes means adapted for cleaning.

18. The cleaning apparatus of claim 17 wherein said means adapted for cleaning includes abrasive means.

19. The cleaning apparatus of claim 18 wherein said abrasive means includes rough bristles.

* * * * *